US010292540B2

(12) United States Patent
Langlotz et al.

(10) Patent No.: US 10,292,540 B2
(45) Date of Patent: May 21, 2019

(54) CONTAINER-ATTACHING SYSTEM

(71) Applicant: BODE CHEMIE GMBH, Hamburg (DE)

(72) Inventors: Christian Langlotz, Hamburg (DE); Stefan Kuboteit, Hamburg (DE); Karin Dusil, Hamburg (DE); Marie Brockmann, Hamburg (DE)

(73) Assignee: BODE CHEMIE GMBH, Hamburg (DE)

( * ) Notice: Subject to any disclaimer, the term of this patent is extended or adjusted under 35 U.S.C. 154(b) by 0 days.

(21) Appl. No.: 15/778,058

(22) PCT Filed: Nov. 22, 2016

(86) PCT No.: PCT/EP2016/078370
§ 371 (c)(1),
(2) Date: May 22, 2018

(87) PCT Pub. No.: WO2017/089323
PCT Pub. Date: Jun. 1, 2017

(65) Prior Publication Data

US 2018/0344100 A1 Dec. 6, 2018

(30) Foreign Application Priority Data

Nov. 24, 2015 (DE) ..... 10 2015 120 279

(51) Int. Cl.
*A47K 5/00* (2006.01)
*A47K 5/12* (2006.01)
(Continued)

(52) U.S. Cl.
CPC ..... *A47K 5/1211* (2013.01); *A47G 23/0225* (2013.01); *A47K 5/00* (2013.01); *A47K 5/05* (2013.01); *A47K 2005/1218* (2013.01)

(58) Field of Classification Search
USPC ..... 248/229.1
See application file for complete search history.

(56) References Cited

U.S. PATENT DOCUMENTS 3,489,385 A 1/1970 Dill
3,734,439 A 5/1973 Wintz
(Continued)

FOREIGN PATENT DOCUMENTS

DE 8624093 U1 10/1986

OTHER PUBLICATIONS

International Search Report and Written Opinion from PCT/EP2016/078370 dated Feb. 7, 2017.
(Continued)

*Primary Examiner* — Monica E Millner
(74) *Attorney, Agent, or Firm* — Dilworth & Barrese, LLP

(57) ABSTRACT

The invention relates to a container-attaching system (1) for making available a container (2), especially provided with a cleaning or disinfecting product, said system comprising: a holder (4, 41) with a receiving region (5) for receiving the container (2), the holder (4, 41) comprising a first attaching region (51), a second attaching region (52) and a third attaching region (53), the first (51), second (52) and third (53) attaching regions comprising wires or rods or plate-type components, and an attaching means (7) for detachably attaching the holder (4, 41) to objects, wherein the attaching means (7) can be fixed to the first attaching region (51) so that it can assume a first holding position, to the second attaching region (52) so that it can assume a second holding position, and to the third attaching region (53) so that it can assume a third holding position.

27 Claims, 8 Drawing Sheets

(51) Int. Cl.
*A47K 5/05* (2006.01)
*A47G 23/02* (2006.01)

(56) References Cited

U.S. PATENT DOCUMENTS

| | | | | |
|---|---|---|---|---|
| 4,531,643 | A * | 7/1985 | Bradley | F16M 13/00 211/64 |
| 4,535,923 | A | 8/1985 | Manke | |
| 5,839,632 | A | 11/1998 | Koday | |
| 6,027,083 | A * | 2/2000 | Chang | A47G 7/044 248/153 |
| 6,527,240 | B1 | 3/2003 | Huang | |
| 7,475,884 | B2 * | 1/2009 | Ryan | B62B 3/14 224/411 |
| 8,740,167 | B1 * | 6/2014 | Collins | A01D 75/00 16/437 |
| 9,357,888 | B2 | 6/2016 | Wegelin et al. | |
| 2004/0140411 | A1 * | 7/2004 | Roe | A47G 23/0225 248/311.2 |
| 2007/0290108 | A1 | 12/2007 | Hofferber | |
| 2012/0181405 | A1 | 7/2012 | Zlatic et al. | |
| 2013/0277517 | A1 | 10/2013 | Wright | |

OTHER PUBLICATIONS

German Search Report dated Nov. 24, 2015.
English Language Translation of International Preliminary Report on Patentablility.

* cited by examiner

CONTAINER-ATTACHING SYSTEM

This application claims priority to German Patent Application No. 102015120279.4 filed on Nov. 24, 2015.

The present invention relates to a container fastening system for making available a container that is filled with cleaning or disinfecting agents and in particular is provided with a metering pump.

The professional hand hygiene is undoubtedly an approach toward preventing the transmission of microbiological pathogens in healthcare, in particular in hospital or care institutions.

The effectiveness of the cleaning and disinfecting agents utilized herein plays an important part. The manner of carrying out the cleaning or disinfecting procedure also has a decisive influence on the effectiveness of cleaning or disinfecting.

Apart from the above, however, the compliance relating to the behavior in disinfecting hands or cleaning hands, consequently the ratio of disinfection actually taking place as compared to the number of opportunities when cleaning or disinfecting should be performed, is of equally important significance.

The opportunities at which cleaning or disinfecting is to be performed often relate to the treatment or care of patients by the personnel providing the care or treatment.

It has been demonstrated that the compliance can be improved when the availability of the cleaning or disinfecting agents is provided in the proximity or, even better, directly at the so-called "point of care", consequently directly where the treatment or the care, thus the contact with the patient, is to be performed.

Container fastening systems which enable cleaning or disinfecting agent containers to be made available at or close to the point of care by way of respective fastening means are therefore already known.

EP-2758950-A1 describes a wire mesh basket, the wire frame of the latter being designed in such a manner that said wire frame can be attached to horizontal installations, such as edges of beds, for example, in that a portion of the frame that is configured in the shape of a hook can be hung over a substantially horizontally oriented object such as a patient bed edge.

DE-198624093-U1 describes receptacle baskets for liquid containers, wherein the latter have an integrated wall mounting such that the container is fittable to a (vertical) wall, for example of a hospital room.

Wire mesh baskets for presenting disinfecting agent containers are also known, a table clamp for fixing the wire mesh basket to table edges being fittable to the round rods of said wire mesh basket that form the base of the latter.

However, the known solutions in terms of the positionability thereof have proven inadequate.

It is therefore the object of the present invention to improve the positionability of known container fastening systems.

This object is achieved by a container fastening system for making available a container that in particular is provided with cleaning or disinfecting agents, comprising:

- a holder having a receptacle region for the container, wherein the holder has a first fastening region, a second fastening region, and a third fastening region, wherein the first, the second, and the third fastening region comprise wires or rods or plate-shaped components, or are formed there from,
- and a fastening means for releasably fastening the holder to objects, wherein the fastening means is fixable to the first fastening region, and the fastening means on account thereof can assume a first holding positon, and the fastening means is fixable to the second fastening region, and the fastening means on account thereof can assume a second holding position, and the fastening means is fixable to the third fastening region, and the fastening means on account thereof can assume a third holding position.

The cleaning or disinfecting agent can in particular be a liquid, gel-type, pasty, or foam-like, or foamable agent, said cleaning or disinfecting agent in particular being alcoholic and non-alcoholic disinfecting agents and liquid soaps.

The shape of the container can be configured so as to be substantially cuboid, or columnar, or conical, or pyramidal. Mixtures of various geometrical basic shapes are conceivable. The storage vessel preferably has a height H, the extent of the latter being greater, in particular greater by at least a factor of 1.5, than the extent of the width B and/or the depth T of the storage vessel. The container at an upper end region preferably has an opening through which a simple pump device, in particular a metering pump, can be inserted in a manner known per se, the opening preferably also being closable by way of fixing said pump device, preferably by means of a screw cap, to the container. The container is furthermore particularly configured so as to be bottle-shaped. It is furthermore conceivable and advantageous for the container to be configured in the manner of a bag. The container can furthermore preferably be configured as a bag-in-box composite container. An inner bag herein is received in an outer box that in comparison to the bag is formed from a more rigid material, for example from plastic or cardboard.

In terms of the holding position it is assumed to be understood that the receptacle region of the holder is alignable in such a manner that the container in an application situation is received in the receptacle region so as to be substantially standing upright, so as to guarantee the functionality of a container that in particular is provided with a manually activatable metering pump in an application situation.

The at least first, second, and third holding position enable the user to align the fastening means in dissimilar ways, so as to fasten the holder selectively to objects that are disposed and extend in dissimilar ways in space, such as plates, rods, or shelves that run vertically or horizontally or obliquely, or components of tables, chairs, bed edges, or bedposts, and infusion stands, station trolleys, serving trolleys, or similar.

To this end, the user, depending on the availability of suitable objects, can fix the fastening means to the first or the second or the third fastening region.

According to one preferred embodiment it is provided, that the first holding position enables the fastening of the holder to a horizontally oriented object, and the second holding position enables the fastening of the holder to a vertically oriented object, and the third holding position enables the fastening of the holder to an obliquely oriented object.

Herein "horizontal(ly)" means parallel with a plane that runs parallel with the horizon, that is to say so as to be perpendicular to the plumb line direction. "Vertical(ly)" means parallel with a plane which runs parallel with the plumb line direction. "Oblique(ly)" means parallel with a plane which intersects a horizontal as well as a vertical plane.

According to a further embodiment, the holder comprises a fourth fastening region to which the fastening means is fixable, on account of which the fastening means can assume at least one further, fourth holding position.

The third holding position, or the further fourth holding position, preferably enables the fastening of the holder to an object that in relation to the horizontal is inclined between 10° and 80°, in particular between 20° and 60°, furthermore particularly between 30 and 50°.

The fastening means can be fixable to the first, as well as to the second, as well as to the third fastening region, and optionally to the fourth fastening region in an arbitrary manner, however in particular in a form-fitting and/or force-fitting manner.

Advantageously, the wires or rods or plate-shaped components of the first, the second, or the third fastening region simultaneously form portions of the receptacle region of the holder.

It has proven particularly advantageous herein for the wires or rods or plate-shaped components of the first fastening region to form at least one portion of a base of the receptacle region.

The wires or rods or plate-shaped components of the second fastening region preferably form at least one portion of a rear part of the receptacle region. Whenever the plural form "wires or rods or plate-shaped components" is used above or hereunder, the singular form "the wire, or the rod or the plate-shaped component" is to be likewise included herein.

The third fastening region is preferably disposed between the first and the second fastening region.

The receptacle region preferably has front support elements which are preferably formed by wires or rods or plate-shaped components and which furthermore preferably form a portion of a front part of the receptacle region. However, the front support elements are preferably not specified for being able to fix the fastening means thereto.

The receptacle region is preferably configured as a frame that is open towards the top such that a container can be placed from above into the frame without tools, and without locking or fixing devices having to be activated, and be retrieved again therefrom.

The first fastening region according to the invention has wires or rods or plate-shaped components, or is preferably formed therefrom, that is to say that said first fastening region is preferably composed of wires or rods or plate-shaped components. In particular, said wires or rods or plate-shaped components in an application situation run parallel with the horizontal, thus parallel with a plane which runs parallel with the horizon. An application situation in the context of the present invention is understood as a situation in which a container for presentation to the user is receivable so as to be substantially upright in the receptacle region of the holder.

The second fastening region according to the invention has wires or rods or plate-shaped components, or is preferably formed therefrom. In particular, said wires or rods or plate-shaped components run perpendicularly to the wires or rods or plate-shaped components of the first fastening region.

The third fastening region, and optionally if present, the fourth fastening region, likewise has wires or rods or plate-shaped components, or is formed therefrom. Said wires or rods or plate-shaped components of the third or fourth fastening region run obliquely to the wires or rods or plate-shaped components of the first fastening region, in particular at an angle of 10° and 80°, furthermore particularly of 20° and 60°, furthermore particularly of 30 and 50°.

In particular, the wires or rods or plate-shaped components are formed from materials known per se, such as plastics or metals, in particular aluminum or steel. Said materials are preferably materials that are immune to alcoholic solutions, so as to be able to regularly clean and disinfect the holder. Said materials are also preferably materials which are capable of being sterilized, in particular steam-sterilized.

The wires or rods can be configured so as to be solid or hollow, that is to say tubular, and preferably have a round, in particular circular cross section. In the latter case, the rods hereunder will also be referred to as round rods. The diameter of the rods is in particular 1 to 10 mm, furthermore particularly 3 to 6 mm. Other, in particular triangular, rectangular or polygonal cross-sectional shapes, are likewise conceivable.

According to further preferred embodiments, the first or the second or the third fastening region, or optionally the fourth fastening region, comprises in each case a pair of wires or rods that run in parallel, or is formed therefrom.

A pair of wires or rods running in parallel, or a plate-shaped component, of the first fastening region preferably run in a first plane, and a pair of wires or rods running in parallel, or a plate-shaped component, of the second fastening region run in a second plane, and a pair of wires or rods running in parallel, or a plate-shaped component, of the third fastening region run in a third plane, and optionally if present, a pair of wires or rods running in parallel, or a plate-shaped component, of the fourth fastening region run in a fourth plane, wherein none of the first to third, and optionally fourth, planes run parallel with any other of the first to third and optionally fourth planes.

A respective pair of wires or rods that run parallel is preferably disposed so as to be equidistant in each case. This means that the spacings between two wires or rods forming a respective pair of the first fastening region and of the second fastening region and of the third fastening region, and optionally of the fourth fastening region, are identical. As will be explained in more detail hereunder, this embodiment enables simple and user-friendly variants in order for the fastening means to be fixed in a flexible manner to the holder.

According to a further preferred embodiment, the front support elements also comprise in each case a pair of wires or rods that run in parallel, or are formed therefrom.

According to one particularly preferred embodiment, the holder, including the receptacle region and the fastening regions thereof, is formed by a continuous wire or rod. The continuous wire or rod herein can be formed from two or a plurality of joined portions. Joining methods known per se, such as, for example materially-integral joining methods such as adhesive bonding, welding, or soldering, are to be considered herein, depending on the material used. Furthermore conceivable are plug connections or other form-fitting and/or force-fitting connection techniques.

However, the wire or rod is most particularly preferably formed from a single wire or rod that in particular is bent or formed curved in portions.

The fastening means preferably has a releasable clamping device by means of which the fastening of the holder to the object is establishable. Other fastening means known per se, such as quick-release fasteners known from the bicycle sector, in particular quick-release fasteners that are manually operable and furthermore particularly without any further tools, are conceivable and comprised by the inventive concept.

The clamping device preferably comprises a first clamping jaw and a second clamping jaw, wherein the spacing of the first clamping jaw from the second clamping jaw is variable. The effective clamping regions of the clamping jaws, in particular in terms of the shape thereof, are preferably configured so as to be dissimilar. The effective clamping region of the first clamping jaw can thus be adapted to the shape of a flat, planar object such as a table or bed edge. The effective clamping region of the second clamping jaw is preferably provided with a V-shaped or U-shaped convexity, and thus approximates, or is adapted to, the shape of a tube or a bar or a rod of a bed frame or of a tripod, or of another bar-type or rod-type object.

It is furthermore advantageous for the effective clamping regions of the first or the second clamping jaw to be provided with an anti-slip coating and/or a coating that protects the surface of the objects, in particular from PVC, latex, silicon, or vulcanized rubber.

The clamping jaws are preferably convergeable and divergeable by way of an in particular manually activatable device, in particular a screw device.

It can be advantageous in particular for the clamping jaws to be convergeable counter to a spring force.

According to one preferred embodiment, the fastening means has an operating lock. The operating lock is particularly suitable for protecting the fastening means against unauthorized use, or protecting the container fastening system in its entirety against theft. To this end, the fastening means preferably has a locking device which in the locked state prevents operation of the fastening means. These herein are preferably locking devices which are known per se, for example from the sector of locking devices which are suitable for fitting a bicycle carrier to a motor vehicle and which are openable and lockable by means of a key or by entering a combination of digits or letters or symbols. According to an alternative embodiment, the operating lock can also be formed in that the fastening means is operable only by way of a special tool such as, for example, a specially designed recess key, such as a pentagonal recess key.

The operation of the fastening means has proven particularly comfortable when by means of the fastening means, in particular of the activation of the screw device, both fastening of the holder to the objects as well as simultaneously and in particular a force-fitting fixing of the fastening means to the first or to the second or to the third fastening regions, or optionally to the fourth fastening regions, is establishable.

The fastening means preferably has a connector means by means of which the fastening means is in particular connectable to the holder, or is furthermore particularly held and fixable. Furthermore, the connector means is preferably specified for being able to move, in particular displace, in particularly manually, the fastening means between each of the first to third holding positions, and optionally the fourth holding position.

According to one particularly preferred embodiment of the invention, the fastening means is captively held on the holder, in particular in a captive form-fitting manner. This can preferably be provided already ex works.

It has proven particularly advantageous for the holder to be mounted so as to be, in particular infinitely, rotatable about an axis, preferably by 360° relative to the fastening means, that is to say to at least one of the components of the fastening means. On account thereof, the holder in one of the holding positions can be moved to a terminal position suitable for the presentation by rotation.

According to a further preferred embodiment of the container fastening system, a fastening region plane, thus the plane in which the pair of round rods that form the respective fastening regions of the holder run in one of the holding positions, is oriented so as to be parallel with an object plane, thus oriented so as to be parallel with that plane in which the objects run and to which the clamping device is fastenable in a respective holding position.

As has already been explained above, a container in a holding position is received so as to be substantially standing upright in the receptacle region of the holder. This has proven to be a position that is particularly suitable for the application situation. It is ensured on account thereof that in the case of a container that is provided with a simple, manually activatable, metering pump the metering pump is activatable by way of a pump impulse that is usually applied manually from perpendicularly above in order for the in particular liquid, but in any case pumpable, cleaning or disinfecting means to be dispensed. The risk of a potentially incorrectly closed container leakage is also minimized.

According to a refinement of the invention, a container in the receptacle region is movable from a first use position to a second use position. This means that a container can assume at least two suitable positions in the receptacle region. In such a case, the first use position corresponds to the particularly suitable position in which the container is received so as to be substantially standing upright in the receptacle region of the holder, as has been described in the preceding paragraph.

Particularly preferably, the first use position differs from the second use position by the degree of inclination of the container relative to the longitudinal direction of the receptacle region of the holder. The degree of inclination is preferably 3 to 45°, in particular 5 to 35°, furthermore particularly 8 to 25°. In such a case, the second use position consequently corresponds to a further suitable position in which the container is received so as to be oblique, in particular so as to be inclined toward the front, in the receptacle region of the holder. A second use position thus enables that, in the case of a container that is provided with a simple, manually activatable, metering pump the metering pump is also activatable by way of a pump impulse that is applied manually or obliquely from above in order for the in particular liquid, but in any case pumpable, cleaning or disinfecting agent to be dispensed. This has proven particularly advantageous when the fastening of the holder is performed to comparatively highly placed objects, and a pump impulse that is applied perpendicularly downward thus being impossible for the user.

A further preferred embodiment relates to a system comprising

- a container fastening system according to one or a plurality of the variants described above or hereunder, and
- a container for cleaning or disinfecting agents, wherein the container is introducible into the receptacle region.

The container is preferably provided for single use, while the container fastening system is suitable for re-use. The system furthermore preferably comprises an in particular manually activatable pump device. The pump device is specified for conveying a cleaning or disinfecting agent from the container. The pump device is advantageously likewise provided for single use, in order for the latter after the container has been emptied to be able to be disposed of conjointly with the container and to thus counteract the dissemination of bacteria. It is nevertheless possible and conceivable for the pump device to be provided for re-use.

The pump device can be releasably fastenable to the container, for example by way of a screw connection, preferably to a region that tapers in the manner of a bottleneck and transitions to an opening on the upper region of the container. In such a case, the screw device simultaneously serves as the closure of this container opening.

The container is particularly expediently formed from an in particular flexible plastic. The sidewalls of the container can advantageously be depressed by way of a light pressure, for example manually, wherein the sidewalls upon depression immediately spring back to the original shape thereof. On account thereof, the container can particularly advantageously be receivable in a force-fitting and form-fitting manner in the receptacle region of the holder.

The receptacle region of the holder furthermore preferably has a depth FT which is larger than the depth T of the container in particular by 0.5 to 5.0 cm, furthermore particularly by 1.0 to 3.0 cm.

The holder is particularly advantageously configured such that the vertically oriented lateral faces of a container that is received in the receptacle region are largely visible such that the lateral faces can be provided with items of information that is important to the user, without said items of information being covered by the holder.

In the case of a container that is configured so as to be substantially cuboid, having corresponding four vertically oriented lateral faces, preferably at least three, in particular all four, lateral faces are freely observable and visible to the user to the extent of at least 90%, in particular at least 95%, furthermore particularly at least 97%, of the respective face.

A further embodiment relates to an assembly comprising at least two container fastening systems according to one or a plurality of the variants described above or hereunder, and at least first and second containers of the variants described above or hereunder, wherein a first container fastening system has a first holder having a first receptacle region, and wherein a second container fastening system has a second holder having a second receptacle region, and wherein the first receptacle region differs from the second receptacle region. The first receptacle region differs from the second receptacle region preferably in such a manner that the first receptacle region can receive a container that in particular in terms of the external shape and/or the dimensions and/or of the maximum possible content, measured in milliliters, differs from that of the second receptacle region.

The first receptacle region preferably has a depth FT, a height FH, and a width FB, and the second receptacle region has a depth FT, a height FH, and a width FB, wherein the first receptacle region differs from the second receptacle region by way of at least one dimension selected from the variables height FH, depth FT, width FB.

In the case of the first or the second or the third fastening region, or optionally the fourth fastening region, of the first and the second container fastening system having in each case one pair of wires or rods running in parallel, or are formed therefrom, a respective pair of wires or rods running in parallel are preferably disposed so as to be equidistant. This means that these wires or rods forming in each case one pair of the first container fastening system have the same mutual spacing as the wires or rods forming a pair of the second container fastening system. This embodiment enables the first and the second container fastening system to be equipped with fastening means that at least in terms of the connector means thereof are identical.

Consequently, the first container fastening system in particular advantageously comprises a first fastening means, and the second container fastening system comprises a second fastening means, wherein the connector means of the first and the second fastening means are configured so as to be identical. In particular, the first and the second fastening means are configured so as to be entirely identical.

According to a further variant of the invention, the first container has a depth T, a height H, and a width B, and the second container has a depth T, a height H, and a width B, wherein the first container differs from the second container by way of at least one dimension selected from the variables height H, depth T, width B.

According to a further embodiment, the assembly furthermore comprises at least one first and one second pump device, wherein the first pump device differs from the second pump device by way of the length PL of the pump devices.

Figure 4A:
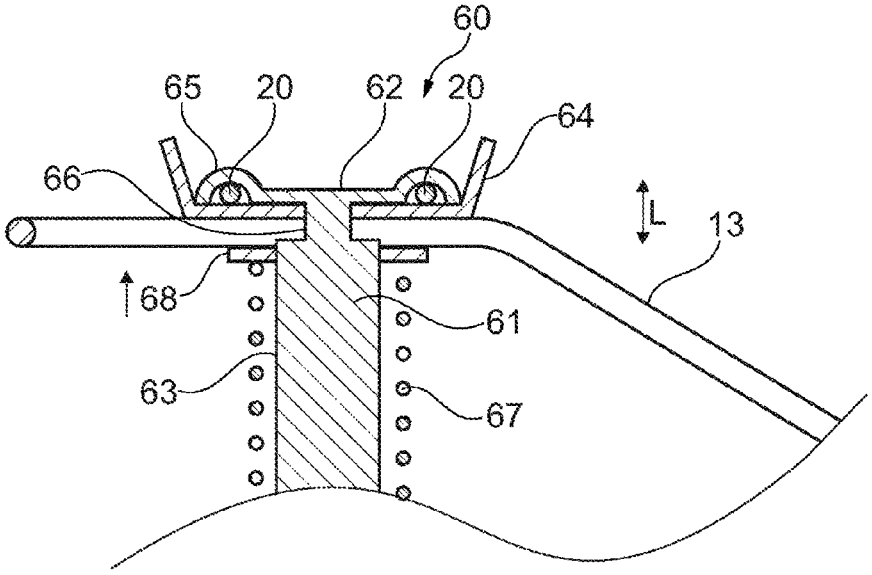
Figure 4B:
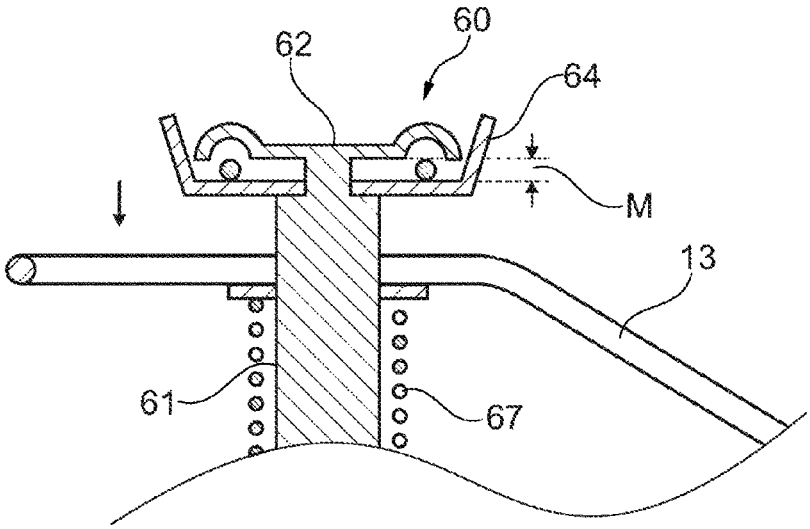
Figure 5A:
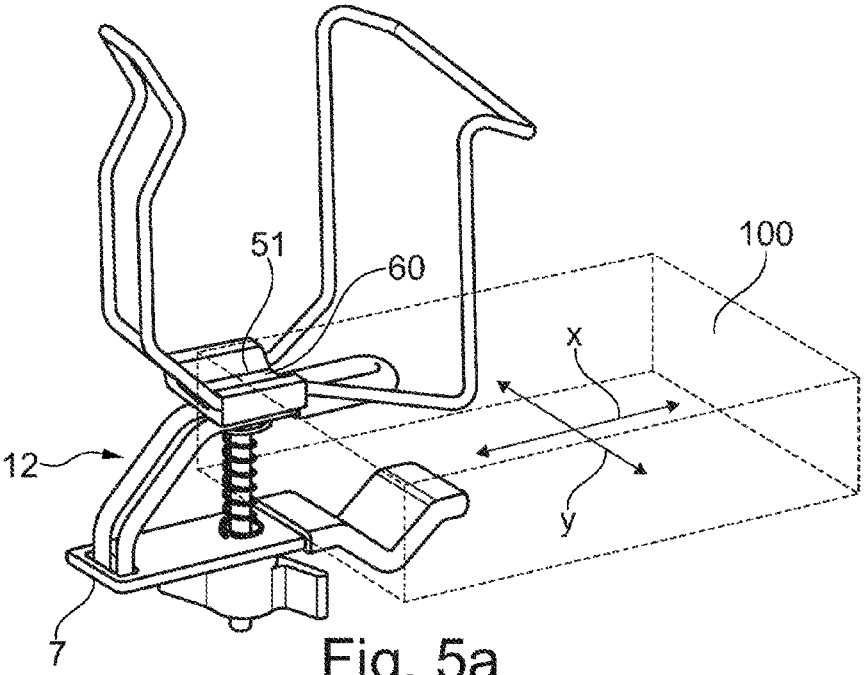
Figure 5B:
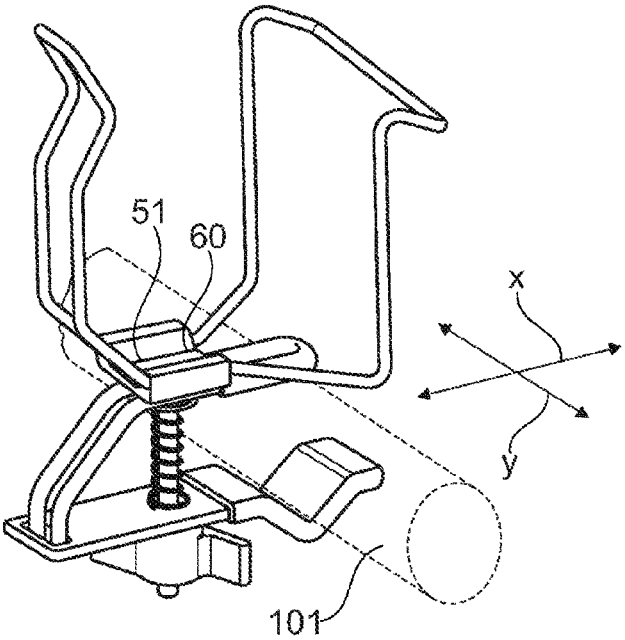
Figure 6B:
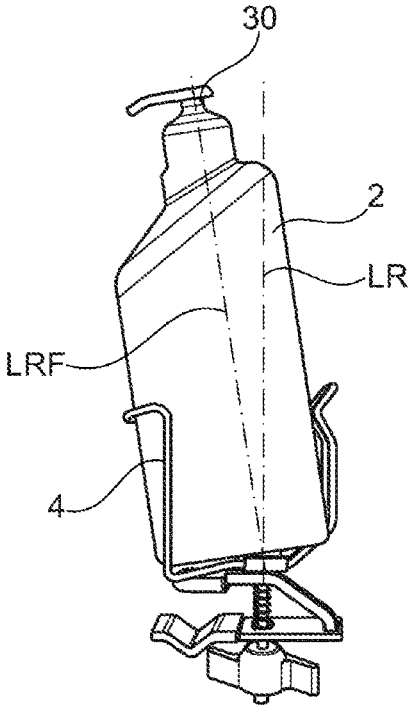
Figure 6A:
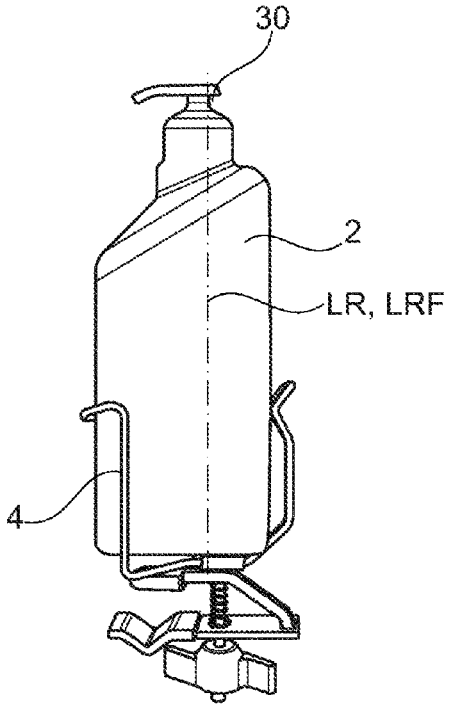
Figure 7:
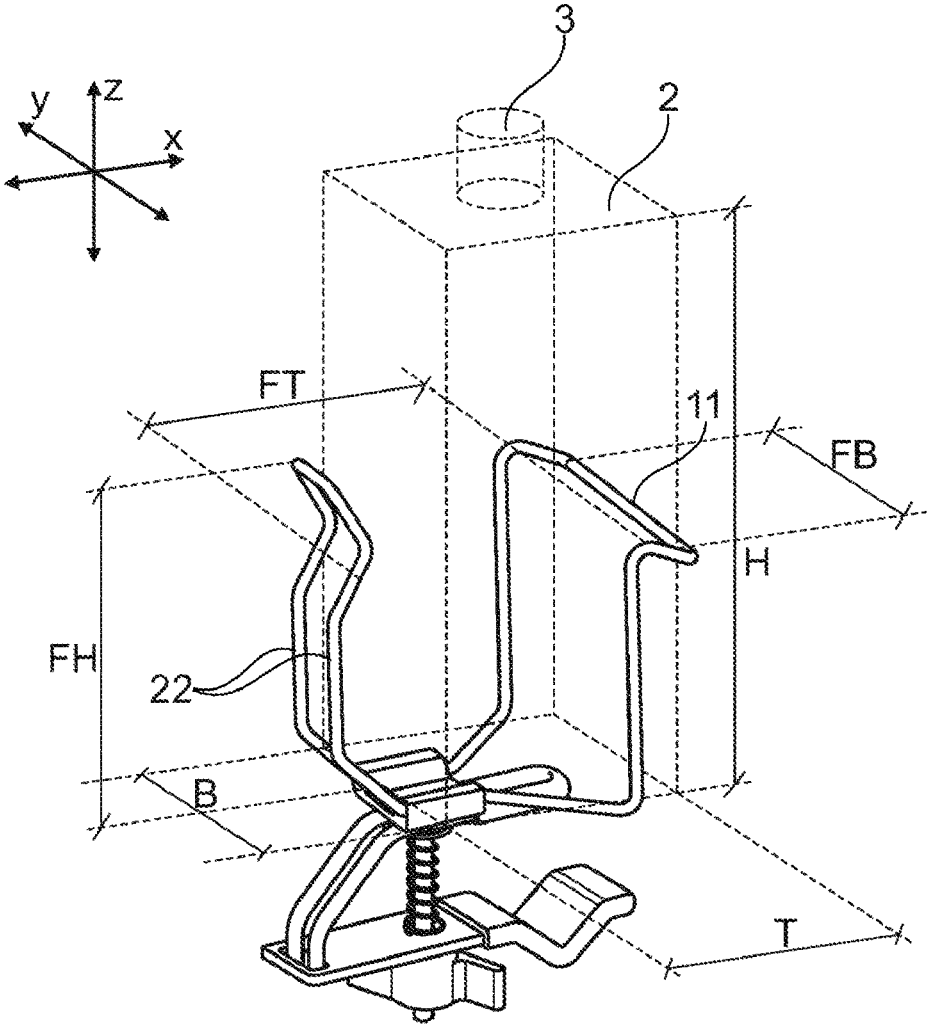
Figure 8:
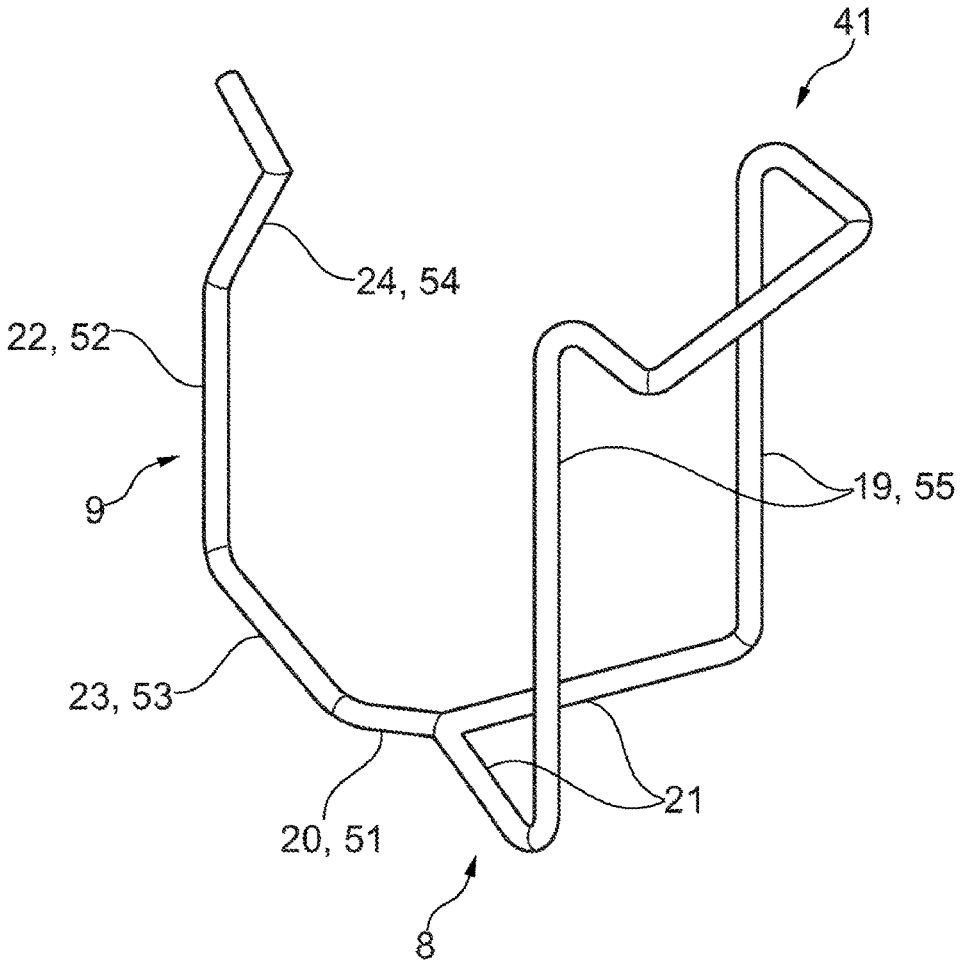

FIGS. 3*a*-3*d* show views of a container fastening system according to the invention in a first, a second, a third, and a fourth holding position;

FIG. 4*a* shows a partial view of a sectional plane through a container fastening system according to the invention;

FIG. 4*b* shows a view corresponding to that of FIG. 4*a*, however having a connector means that is relieved of the spring force of a helical spring;

FIGS. 5*a* and 5*b* show schematic views of a container fastening system that is fastened to an object;

FIG. 6*a* shows a view of a first use position, having a container received in the container fastening system;

FIG. 6*b* shows a view of a second use position, having a container that is received in the container fastening system;

FIG. 7 shows a schematic view of a container that is received in a container fastening system; and FIG. 8 shows a further holder.

Figure 1:
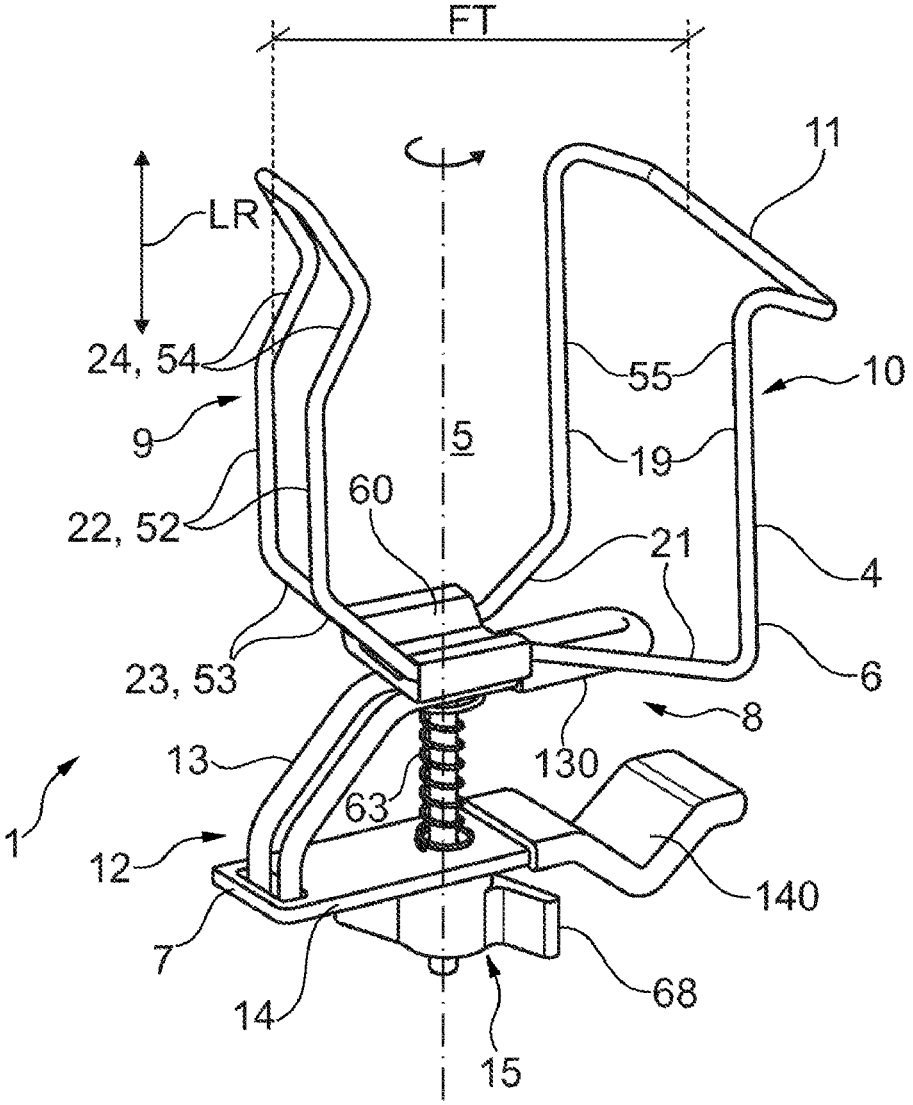
FIG. 1 shows a container fastening system according to the invention.
Figure 2:
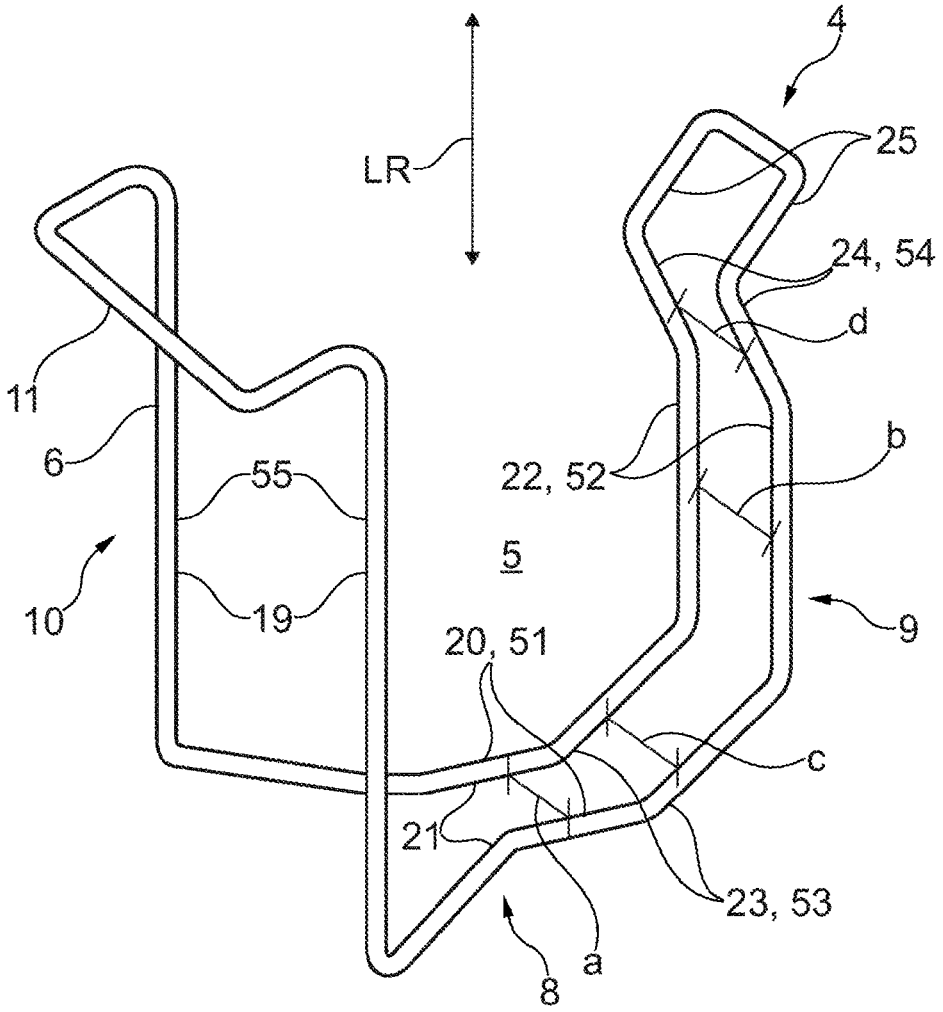
FIG. 2 shows the holder of FIG. 1 in a further view.

FIG. 1 shows an embodiment of a container fastening system 1 according to the invention. In FIG. 2 the holder is illustrated in a further view (rotated by 180°) but without a fastening means that is provided ex works. The following description is first carried out with reference to FIGS. 1 and 2. The container fastening system 1 has a holder 4 and a fastening means 7. The holder 4 has a receptacle region 5 which is specified for receiving a container (not illustrated). To this end, the holder 4 is formed from a plurality of portions of a single continuous round rod 6 that is bent in portions and forms the receptacle region 5. The round rod 6 is composed of stainless steel and has a diameter of 4.0 mm. Whenever the term "round rods" or "round rod" is used hereunder, this herein also refers to portions of the continuous round rod 6.

The receptacle region 5 comprises a base 8, a rear part 9, and a front part 10. The front part 10 has a pair of round rods 19, running in parallel in the longitudinal direction LR of the holder 4, for forming front support elements 55 of a length of 80 mm, which have a mutual spacing of 80 mm, or according to a second embodiment of the holder 4, of 65 mm.

Said round rods 19 in an upper region of the front part 10 are connected by way of a bent feature that is oriented so as to be substantially transverse to the longitudinal direction LR. The bent feature is likewise formed by around rod 11.

The base 8 in a first portion has a pair of round rods 20 of a length of 20 mm said round rods 20 running so as to be mutually parallel and transversely (90°) to the longitudinal direction LR in a first plane. The mutual spacing of said round rods 20 in this first portion of the base 8 is a=20 mm. As is explained in more detail below, these round rods form a first fastening region 51.

In a second portion of the base 8, the round rods 20 of the first portion of the base 8 transition into two round rods 21 of a length of 25 mm, or according to a second embodiment of the holder 4 of a length of 40 mm, that are outwardly buckled by 45°, the mutual spacing of said round rods 21 steadily increasing as the distance from the first portion of the base 8 increases, wherein the round rods 21 of the second portion of the base 8 likewise run in the first plane so as to finally transition in a short arc into the round rods 19 of the front part 10 that run substantially in the longitudinal direction LR of the holder 4.

The rear part 9 in a first portion has a pair of round rods 22 of a length of 40 mm, said round rods 22 in a second plane running in parallel in the longitudinal direction LR of the holder and thus perpendicularly to the round rods 20 of the first portion of the base, and which have a mutual spacing of b=20 mm. As is explained in more detail below, said round rods 22 form a second fastening region 52.

A further pair of round rods 23 running in parallel in an oblique manner, specifically at an angle of 45° to the round rods 20 of the first portion of the base 8 and in a third plane, are disposed running in an intermediate part of the holder 4 between said round rods 22 of the first portion of the rear part 9 and the round rods 20 of the first portion of the base 8 in such a manner that said further pair of round rods 23 running in parallel, having a length of 28 mm, connect the round rods 20 of the first portion of the base 8 to those of the first portion of the rear part; the respective round rods thus in each case transition into one another in a short arc. The spacing of the round rods 23 in the intermediate part is also c=20 mm. As is explained in more detail below, these round rods form a third fastening region 53.

The round rods above the round rods 22 of the first portion of the rear part 9, by way of a short bend, transition into a pair of round rods 54, running in parallel, of the second portion of the rear part 8. The round rods 54 of the second portion of the rear part 9 are disposed so as to run obliquely, in the present case specifically at an angle of 45°, to the round rods 22 of the first portion of the rear part 9, specifically so as to be directed inward, and thus running in a fourth plane. The spacing of these round rods 54 which have a length of 18 mm is also d=20 mm. As is explained in more detail below, said round rods 54 form a fourth fastening region 54. Said round rods of the second portion of the rear part 9, by way of a short bend, transition into round rods 25 of the end portion of the rear part 9. The round rods 25 of the end portion of the rear part 9 are disposed so as to run outward perpendicularly, that is to say at an angle of 90°, to the round rods 24 of the second portion of the rear part. A constriction of the receptacle region 5 is formed on account of the short inwardly directed bend between the round rods 25 of the end portion of the rear part 9 and the round rods 24 of the second portion of the rear part 9.

The holder (FIG. 2) presently has four fastening regions 51, 52, 53, 54 that are in each case formed by a pair of round rods 20, 22, 23, 24 running in parallel, the fastening means 7 being able to be fixed to said fastening regions 51, 52, 53, 54. The fastening means in FIG. 1 is fixed to the first fastening region such that the connector means 60, which will be described in more detail below, obscures the view onto the round rods that in FIG. 1 form the first fastening region.

The fastening means 7 illustrated in FIG. 1 has a clamping device 12 by means of which the fastening of the holder 4 to the objects can be performed. The clamping device 12 has a first clamping jaw 13 and a second clamping jaw 14, wherein the spacing of the first clamping jaw 13 from the second clamping jaw 14 is variable by an in particular manually activatable screw device 15 in such a manner that the clamping jaws are convergeable and divergeable. In the embodiment illustrated, the second clamping jaw 14 is configured so as to be plate-shaped, wherein the effective clamping region 140 of the second clamping jaw 14 has a convexity which is adapted to the shape of a bar-shaped or rod-shaped object. The first clamping jaw 13 is composed of round rods running in parallel. At a distal end of the clamping jaw 13, the two round rods are interconnected by way of a tight bend in order for the effective clamping region 130 of the first clamping jaw 13 to be formed. The effective clamping region 130 of the first clamping jaw 13 is thus adapted to the shape of a plate-shaped, planar object that extends in a planar manner. The clamping device 12 is specified for being able to be fastened to bar-shaped or plate-shaped objects of a thickness or wall thickness of 10 to 50 mm, in particular 15 to 45 mm. The two round rods at the proximal end are articulated on the proximal end of the second clamping jaw 14.

The regions 130, 140 of the clamping jaws that in terms of the clamping effect are effective on an object have in each case one plastic cover in order for the surface of the object to be protected.

The second clamping jaw 14 has a bore through which a lower portion of a bolt pin 63 (described in more detail below) is routed. Prior thereto, the bolt pin 63 is routed between the round rods of the first clamping jaw 13.

The second clamping jaw 14 is simultaneously a detent for the connector means 60 (described in more detail below) of the fastening means 7.

Figure 3A:
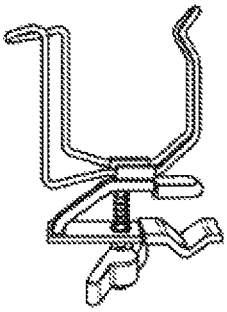

FIGS. 3*a* to 3*d* show the holder 4 having the fastening means 7 that is fixed to the four different fastening regions 51, 52, 53, 54 as follows, wherein the reference signs refer to the illustration of FIGS. 1 and 2:

FIG. 3*a* corresponds to the illustration of FIG. 1. The fastening means 7 is fixed to the first fastening region 51 such that the fastening means 7 can assume a first holding position. The receptacle region 5 of the holder 4 in this first holding position is aligned in such a manner that the container in the first holding position is receivable so as to be substantially standing upright. The first holding position presently enables the user to fasten the fastening means 7 to an object that in the space extends parallel to a horizontal plane, such as for example a bar or a table edge. The object plane thus runs horizontally.

Figure 3B:
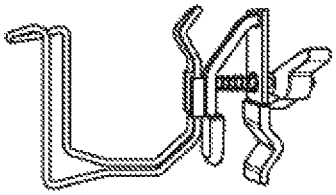

The fastening means 7 in FIG. 3*b* is fixed to the second fastening region 52 such that the fastening means 7 can assume a second holding position. The receptacle region 5 of the holder 4 in this second holding position is also aligned in such a manner that the container in the second holding position is receivable so as to be substantially standing upright. The second holding position presently enables the user to fasten the fastening means 7 to an object that extends vertically in the space. The object plane thus runs vertically.

Figure 3C:
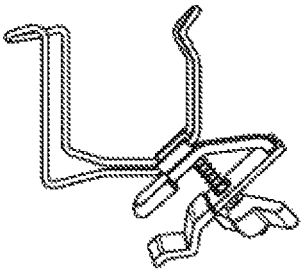
Figure 3D:
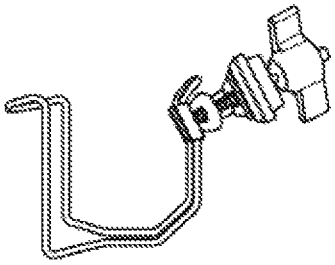

The fastening means 7 in FIGS. 3*c* and 3*d* is fixed to the third fastening region 53 (FIG. 3*c*) or to the fourth fastening region 54 (FIG. 3*c*), respectively, such that the fastening means 7 can assume a third holding position (FIG. 3*c*), or a fourth holding position (FIG. 3*d*). Consequently, the receptacle region 5 of the holder 4 in these holding positions is also alignable in such a manner that the container is receivable so as to be substantially standing upright. The third and the fourth holding position presently enable the user to fasten the fastening means 7 to an object that extends obliquely in the space. The object plane in these cases thus runs obliquely.

The connector means 60 in the manner described hereunder with reference to FIG. 4*a* is specified for being able to manually move, in particular displace, the clamping device 12 between each of the first to fourth holding positions.

The connector means 60 comprises a bolt 61 having a plate-shaped bolt head 62 and a bolt pin 63, already mentioned above. Moreover a detent plate 64, wherein the detent plate 64 and the bolt head 62 are specified for captively receiving a pair of round rods, running in parallel, of the first or second or third or fourth fastening region of the holder between the detent plate 64 and the bolt head 62. To this end, the bolt head 62 has two correspondingly shaped convexities or undulations 65 that run in parallel. The round rods 20 that form a first fastening region are received in the illustrated case of FIG. 4*a*. The detent plate 64 has a bore through which an upper constricted bolt pin portion 66 that is proximal to the bolt head is routed. To this end, the bolt pin 63 in this upper portion has a reduction in the diameter D thereof to D1. The longitudinal extent of the constriction, that is to say the extent of the latter in the longitudinal direction L, is greater than the thickness of the detent plate 64. The bore of the detent plate is sufficiently large in order for the constricted bolt pin portion 66 to be received. However, said bore is sufficiently small in order to impact the non-constricted portion of the bolt pin such that the detent plate 64 is captively held without play in the longitudinal direction L between the bolt head 62 and the end of the constricted bolt pin portion 66. The bolt pin 63 below the detent plate 64 is routed, as described above, between the round rods of the first clamping jaw 13 and further through a bore of the second clamping jaw 14 (not illustrated in the partial view of FIG. 4*a*). A helical spring 67 is pulled over the bolt pin 63 between the clamping jaws 13, 14.

The bolt pin 64 is also part of the screw device 15 (FIG. 1). To this end, the bolt pin 63 has an external thread on a foot part. The screw device 15 moreover comprises a nut having an internal thread, which is screwed onto the foot part of the bolt pin 63. The nut in the case illustrated is configured as a manually activatable wingnut 68. According to an alternative embodiment, a knurled screw, in particular a star-shaped knurled screw, that is provided with a lock and is lockable by means of a separate key can be provided instead of the wingnut 68.

The force of the helical spring 67 that is pulled over the bolt pin 63 in a portion between the clamping jaws 13, 14 that acts in the longitudinal direction L of the bolt pin 63 presses the first clamping jaw 13 against the detent plate 64. In the embodiment illustrated, a washer 68 is disposed between the helical spring and the first clamping jaw 13, so as to be able to transmit the pressure of the helical spring 67 to the first clamping jaw 13 in a homogenized manner. By way of the pressure exerted (in the direction of the arrow, FIG. 4*a*) by the helical spring 67 on the detent plate 64, the detent plate 64 bears directly on the bolt head 62 such that the round rods that form a fastening region, in the case of FIG. 4*a* the round rods 20 that form the first fastening region, are held in a force-fitting and form-fitting manner between the detent plate 64 and the bolt head part 62. This state is schematically drawn in FIG. 4*a*.

In the case of the clamping device 12 being fastened to an object, the object is guided between the regions 130, 140 of the clamping jaws 13, 14 that are effective in terms of the clamping effect. Tightening by means of the activation of the wingnut 68 is subsequently performed such that the clamping jaws 13, 14 are first converged counter to the resistance of the helical spring and subsequently counter to the resistance of the clamped object. The first clamping jaw 13 here presses against the detent plate 64 with an increasing force and an increasing clamping effect such that the round rods that form the first fastening region 51 are held increasingly tightly and are fixed between the detent plate 64 and the bolt head part 62. Consequently, fastening of the holder 4 to the objects as well as the simultaneous force-fitting fixing of the clamping device to the first, or to the second, or to the third fastening region, or to the fourth fastening regions, is establishable by way of the screw device 15.

It has proven particularly advantageous for the holder 4 conjointly with the connector means 60 to be rotatable relative to the clamping jaws 13, 14, in particular to be rotatable by 360° about a longitudinal axis of the bolt pin, as is illustrated.

It has furthermore proven particularly advantageous for the connector means 64 to be specified for being able to manually displace the fastening means 7 between each of the first to fourth holding positions. As long as the clamping device 12 is not fastened to an object, the clamping jaws 13, 14 can be manually converged, for example between the thumb and the index finger of a user and counter to the light spring force of the helical spring. On account thereof, the detent plate 64 is relieved of the pressure of the helical spring, on account of which the pressure plate 64 is divergeable from the bolt head 62 by a dimension M, in the case illustrated by 5.0 mm, in the longitudinal direction L of the bolt pin 61 along the constricted bolt pin portion 66. This state is schematically drawn in FIG. 4*b*. The dimension M and the shaping of the detent plate 64 and of the bolt head part 62 are mutually adapted and specified such that the round rods that form the first, the second, the third, and/or the fourth fastening region are captively held also in this state of the maximum possible spacing between the detent plate 64 and the bolt head part 62. By contrast, the clamping device 12 in this state can be effortlessly displaced from one holding position to another. To this end, the dimension M and the shaping and dimension of the detent plate 64 and of the bolt head part 62 are mutually adapted and specified such that the connector means 60 is movable also across the short arcs which separate the fastening regions from one another such that the first to fourth holding positions illustrated in FIGS. 3*a*-3*d* are assumable. Since the round rods 25 of the end portion of the rear part 9 are disposed so as to run perpendicularly, that is to say in an outward manner at an angle of 90° to the round rods 24 of the second portion of the rear part, the dimension M is however not sufficient for moving the connector means 60 also across the short arc which connects the round rods 25 of the end portion to the round rods 24 of the second portion of the rear part. Therefore, the fastening means in the preferred embodiment cannot be completely separated from the holder.

On account thereof, the user is thus enabled in a particularly comfortable manner to provide different holding positions of the clamping device in order for the objects that specifically present themselves at the point of care to be able to be used in a flexible manner in order for the holder to be fastened.

In the embodiment of the container fastening system 1 illustrated, the fastening region plane, thus the plane in which the pair of round rods that form the respective fastening regions of the holder run in a holding position, is oriented so as to be parallel with an object plane, thus oriented in relation to a plane in which the objects run and to which the clamping device is fastenable in a respective holding position. FIGS. 5*a* and 5*b* show this in an exemplary manner. The clamping device 12 that forms the fastening means 7 here is fixed to the first fastening region 51 in the first holding position. In the application situation, the round rods that form the first fastening region run in the horizontally running plane, so as to be able to receive a container that is standing upright in the receptacle region of the holder (obscured in the view of FIGS. 5*a* and 5*b* by the connector means 60, thus not visible). The regions of the clamping jaws that in terms of the clamping effect are effective here are aligned such that said regions are fixable to objects which likewise run parallel with a horizontally running plane. In the case of FIG. 5*a* said object is schematically illustrated as a plate-shaped portion of a table edge 100. The object is schematically illustrated as a portion of a bed bar 101 in FIG. 5*b*. A horizontally running plane in FIGS. 5*a* and 5*b* is indicated by the mutually intersecting arrows X and Y. The object plane in both cases runs parallel with the fastening plane.

The parallelism of the fastening plane and the respective object plane has the advantage that the user who intends to fasten the container fastening system to an object at the point of care can vary rapidly take a decision pertaining to a suitable holding position, consequently the most suitable fastening region for fixing the fastening means 7 to the holder.

FIGS. 6*a* and 6*b* schematically visualize a further advantage of the particularly preferred embodiment of the invention described. A container 2 having a metering pump 31 is moved to a first use position according to FIG. 6*a*, said container 2 being suitable for receiving in the receptacle region of the holder 4 particularly in terms of the dimension of said container 2.

This first use position corresponds to a particularly suitable position in which the container 2 is received so as to be substantially standing upright in the receptacle region of the holder 4. An imaginary longitudinal direction LRF of the container 2 herein is aligned so as to be parallel with the longitudinal direction LR of the receptacle region of the holder 4.

Image 6*b* shows the container 2 once the latter has been transferred from the first use position to a second use position.

The first use position differs from the second use position at least by way of the degree of the inclination of the container relative to the longitudinal direction LR of the receptacle region. The second use position in the case illustrated is enabled in that the depth of the receptacle region 5 of the holder 4, proceeding from the base 8 of the holder 4, initially increases toward the top in that the round rods 23 in the third fastening region 53 bend outwards before said round rods 23 as the round rods 22 in the second fastening region 52 run substantially perpendicularly to the round rods 20, 21 that form the base 8 of the receptacle region 5, so as then, as round rods 24, bending inward to form the fourth fastening region 54 (cf. FIG. 2). On account thereof, space is achieved for the second use position, so to speak.

In the case illustrated, the degree of the inclination of the container, that is to say the angle of a longitudinal direction of the container LRF in relation to a longitudinal direction LR of the receptacle region, is 10°. Consequently, the second use position corresponds to a further suitable position in which the container is received obliquely, so as to be inclined toward the front, in the receptacle region of the holder. The second use position thus enables the metering pump to be activatable also by a pump impulse that is manually applied from obliquely above in order for the in particular liquid, in any case pumpable, cleaning or disinfecting agent to be dispensed in the case of a container that is provided with a simple, manually activatable, metering pump.

FIG. 7 schematically shows a container 2 which is drawn as a dotted line and which is received in the receptacle region of a container fastening system according to the invention. The container 2 in an exemplary manner has the shape of a cuboid having the height H, the depth T, and the width B. The height H is 16.0 cm. The depth T is 8.0 cm. The width B is 8.0 cm. The container 2 has a schematically indicated flange 3 to which a metering pump (not illustrated) can be flange-fitted.

Moreover the height FH, the width FB, and the depth FT of the receptacle region of the holder are drawn. The depth FT is 9.5 cm. It is here assumed that the depth FT of the receptacle region is understood to be defined by the spacing in the x-direction of those components of the holder that delimit the depth of the receptacle region. In the case illustrated, this is the spacing of the round rod 11 that forms the bend of the front part of the holder from the round rods 22 that form the second fastening region. The height FH of the receptacle region is 9.5 cm and corresponds to the maximum extent in the z-direction of those components of the holder that form the receptacle region. The width FB of the receptacle region is defined by the spacing in the y-direction of those components of the holder that delimit the width of the receptacle region. In the case illustrated, this is the mutual spacing of the two support elements of the front part of the holder, said spacing in the case illustrated being FB=8.0 cm.

It can moreover be seen that only an extremely small proportion of the faces of the four vertically oriented visible sides of the container 2 is obscured by the holder. On account thereof, the user has the opportunity of being able to be aware of potential items of information that are present on the visible faces, such as printed labels which are attached to the visible sides. In the case illustrated, only approximately 5% of a respective face is obscured by the round rods of the holder, such that approximately 95% of the respective face is freely observable and visible to the user.

FIG. 8 shows a further holder 41 of a container fastening system according to the invention, in which a first portion of the base 8 of the holder 41 is configured by a single round rod 20 in order for the first fastening region 51 to be formed. The first portion of the rear part 9 is also configured by a single round rod 22 in order for the second fastening region 52 to be formed. The second portion of the rear part 9 is also configured by a single round rod 24 in order for the fourth fastening region 54 to be configured. Finally, the third fastening region 53 is configured by a single round rod 23 of the intermediate part of the holder. By contrast, the second portion of the base 8 is formed by a pair of round rods 21 which, proceeding from the end of the round rod 20 of the first portion of the base 8, extend in the manner of a V by way of an increasing spacing, so as to by way of a short arc are to transition into round rods 19 which form the front support elements 55 of the holder 41.

A fastening means (not illustrated) can have, for example, a clamping device such as has been described with reference to FIG. 1. A connector means for connecting the clamping device to the holder 41 in such a case can be adapted to the shape of a single round rod such that the fastening means by means of the connector means is connectable to the first fastening region, as well as to the second fastening region, as well as to the third fastening region, as well as also to the fourth fastening region, and is movable across the fastening regions.

According to a further embodiment (not illustrated), the fastening regions 51, 52, 53, 54 illustrated in FIG. 8 are not formed by single round rods but by single plate-shaped components, in particular flat metal sheets. A connector means for connecting the clamping device to the holder 41 in such a case can be adapted to the shape of a respective metal sheet such that the fastening means by means of the connector means is connectable to the first fastening region, as well as to the second fastening region, as well as to the third fastening region, as well as to the fourth fastening region, and is movable across the fastening regions.

The invention claimed is:

1. A container fastening system (1) for making available a container (2) containing cleaning or disinfecting agents, the container fastening system comprising:

a holder (4, 41) having a receptacle region (5) for the container (2), wherein the holder (4, 41) comprises a first fastening region (51) on the holder, a second fastening region (52) on the holder, and a third fastening region (53) on the holder, wherein each of the first (51), the second (52), and the third fastening region (53) on the holder are comprised of wires or rods or plate-shaped components, and a fastening means (7) for releasably fastening the holder (4, 41) to objects, wherein the fastening means (7) is fixable to the first fastening region (51), and the fastening means (7) on account thereof can assume a first holding position, which enables the fastening of the holder (4,41) to a horizontally oriented object, and wherein the container (2) is then substantially upright in the receptacle region of the holder, and the fastening means (7) is fixable to the second fastening region (52), and the fastening means (7) on account thereof can assume a second holding position, which enables the fastening of the holder (4,41) to a vertically oriented object, and the fastening means (7) is fixable to the third fastening region (53), and the fastening means (7) on account thereof can assume a third holding position, which enables the fastening of the holder (4,41) to a obliquely oriented object.

2. The container fastening system (1) of claim 1, wherein the holder (4, 41) further comprises a fourth fastening region (54) to which the fastening means (7) is fixable, on account of which the fastening means (7) can assume at least one fourth holding position, and wherein the fourth fastening region (54) comprises wires or rods or plate-shaped components.

3. The container fastening system (1) of claim 1, wherein the fastening means (7) is releasably fixable in a force-fitting manner to the first (51) as well as to the second (52) as well as to the third fastening region (53).

4. The container fastening system (1) of claim 1, wherein the wires or rods or plate-shaped components of the first (51), second (52), or third fastening region (53), form portions of the receptacle region of the holder (4, 41).

5. The container fastening system (1) of claim 1, wherein the third holding position enables the fastening of the holder (4, 41) to an object that in relation to the horizontal and/or to the vertical is inclined between 10° and 80°.

6. The container fastening system (1) of claim 1, wherein the wires or rods or plate-shaped components of the first fastening region (51) form at least one portion of a base (8) of the holder (4, 41).

7. The container fastening system (1) of claim 1, wherein the wires or rods or plate-shaped components of the second fastening region (52) form at least one portion of a rear part (9) of the holder (4, 41).

8. The container fastening system (1) of claim 1, wherein the the third fastening region (53) is disposed between the first (51) fastening region and the second (52) fastening region.

9. The container fastening system (1) of claim 1, wherein the holder (4, 41) further comprises a front support element (55) which form a portion of a front part (10) of the holder (4, 41).

10. The container fastening system (1) of claim 1, wherein the wires or rods or plate-shaped components of the first fastening region (51) in an application situation run in parallel.

11. The container fastening system (1) of claim 1, wherein the wires or rods or plate-shaped components of the second fastening region (52) run perpendicularly to the wires or rods or plate-shaped components of the first fastening region (51).

12. The container fastening system (1) of claim 1, wherein the wires or rods or plate-shaped components of the third (53) fastening region run obliquely to the wires or rods or plate-shaped components of the first fastening region (51).

13. The container fastening system (1) of claim 1, wherein the first (51) or the second (52) or the third fastening region (53), comprises one pair of wires or rods running in parallel, or is formed therefrom.

14. The container fastening system (1) of claim 13, further comprising wherein a respective pair of wires or rods running in parallel are disposed so as to be equidistant such that the spacings between two wires or rods forming a respective pair of the first fastening region (51) and of the second fastening region (52) and of the third fastening region (53), are identical.

15. The container fastening system (1) of claim 13 wherein the pair of wires or rods running in parallel of the first fastening region (51) run in a first plane, and the pair of wires or rods running in parallel of the second fastening region (52) run in a second plane, and the pair of wires or rods running in parallel of the third fastening region (53) run in a third plane, wherein none of the first to third planes run parallel with any other of the planes.

16. The container fastening system (1) of claim 1, wherein the holder (4, 41) is formed by a continuous wire or rod.

17. The container fastening system (1) of claim 1, wherein the fastening means (7) is captively held on the holder (4, 41).

18. The container fastening system (1) of claim 1 wherein the fastening means (7) has a clamping device (12) by means of which the fastening of the holder (4, 41) to the objects is establishable.

19. The container fastening system (1) of claim 18, wherein the clamping device (12) has a first clamping jaw (13) and a second clamping jaw (14), wherein the spacing of the first clamping jaw (13) from the second clamping jaw (14) is variable.

20. The container fastening system (1) of claim 19, wherein the clamping jaws (13, 14) are convergeable and divergeable by way of a screw device (15).

21. The container fastening system (1) of claim 20, wherein the clamping jaws (13, 14) are convergeable counter to a spring force.

22. The container fastening system (1) of claim 20, wherein both fastening of the holder (4, 41) to the objects, as well as simultaneously a force-fitting fixing of the fastening means (7) to the first (51) or to the second (52) or to the third fastening region (53), is establishable by means of the screw device (15).

23. The container fastening system (1) of claim 1, wherein the fastening means (7) has a connector means (60) and the connector means (60) is specified for being able to displace the fastening means, between each of the first to third holding positions.

24. The container fastening system (1) of claim 1, wherein the holder (4, 41) is mounted so as to be, rotatable about an axis, relative to the fastening means (7).

25. The container fastening system (1) of claim 1, wherein the container (2) in the receptacle region (5) is movable from a first use position to a second use position.

26. The container fastening system (1) of claim 25, wherein the first use position differs from the second use position by the degree of inclination of the container relative to a longitudinal direction of the holder (4, 41).

27. A system comprising a container fastening system (1) as claimed in claim 1, and wherein the container (2) for cleaning or disinfecting agents, is introducible into the receptacle region (5).

* * * * *